US006883803B1

(12) United States Patent
Barry

(10) Patent No.: US 6,883,803 B1
(45) Date of Patent: Apr. 26, 2005

(54) TOURIST GAME

(76) Inventor: Dennis P. Barry, 1420 Hollywood Ave., Bronx, NY (US) 10461

( * ) Notice: Subject to any disclaimer, the term of this patent is extended or adjusted under 35 U.S.C. 154(b) by 0 days.

(21) Appl. No.: 09/699,955

(22) Filed: Oct. 30, 2000

(51) Int. Cl.[7] ..... A63F 3/00
(52) U.S. Cl. ..... 273/254; 273/290; 273/291
(58) Field of Search ..... D21/386, 388, D21/391, 108; 446/85, 106, 117; 273/281, 289, 282.1, 282.2, 282.3, 288, 290, 297, 251, 252, 254, 249, 250, 146, 291, 260, 261, 248, 242, 258, 255, 262

(56) References Cited

U.S. PATENT DOCUMENTS

| | | | | | |
|---|---|---|---|---|---|
| 91,233 | A | * | 6/1869 | Hyatt, Jr. | 273/291 |
| 3,588,114 | A | * | 6/1971 | Vogel | 273/291 |
| 3,608,904 | A | * | 9/1971 | Margetson | 273/291 |
| 3,642,286 | A | * | 2/1972 | Moore | 273/243 |
| 3,709,498 | A | * | 1/1973 | Liston | 273/146 |
| 3,806,125 | A | * | 4/1974 | Bialek | 273/241 |
| 3,881,731 | A | * | 5/1975 | Droney | 273/260 |
| 4,093,235 | A | * | 6/1978 | Barry | 273/254 |
| 4,182,516 | A | * | 1/1980 | Gill | 273/258 |
| 4,213,615 | A | * | 7/1980 | Price | 273/260 |
| 5,601,289 | A | * | 2/1997 | Hollister | 273/241 |
| 6,161,832 | A | * | 12/2000 | Holahan et al. | 273/153 S |

* cited by examiner

*Primary Examiner*—Gregory Vidovich
*Assistant Examiner*—Alvin A. Hunter, Jr.
(74) *Attorney, Agent, or Firm*—Darby & Darby

(57) ABSTRACT

A board game apparatus for educating players with respect to tourist attractions within a particular geographical region that includes a gameboard having a continuous path of areas representing particular localities within the geographical region and a set of cards having either questions concerning various tourist attractions of the localities or other instructions. Another set of cards represent rewards obtained during the course of playing the game. Each of the areas representing the localities are marked to indicate whether a locality is accessible by a conveyance such as a boat and/or by an airplane while all of the localities are accessible by a car. Each player has a single multi-token of parallelepiped shape with a side surface each having a respective representation of an automobile, a boat and an airplane that is permitted to occupy only those areas designated as being accessible by that particular conveyance and whose ends designate STOP and GO attributes.

25 Claims, 5 Drawing Sheets

FIG. 2a
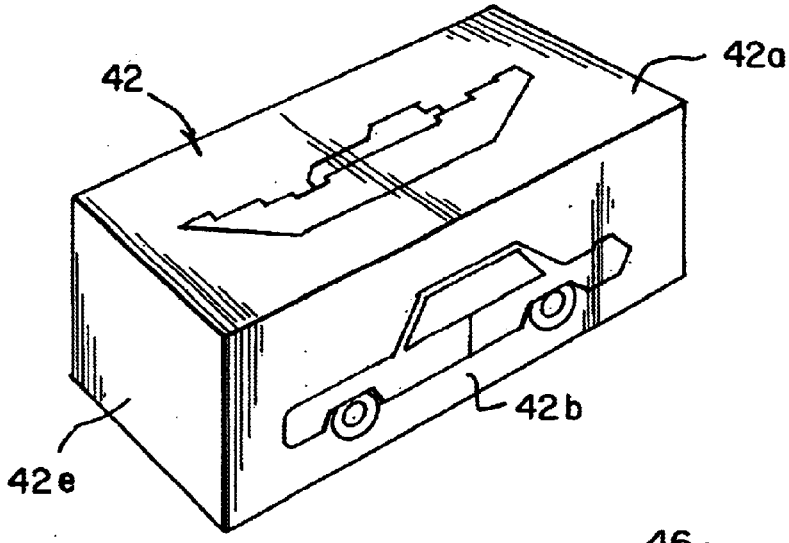
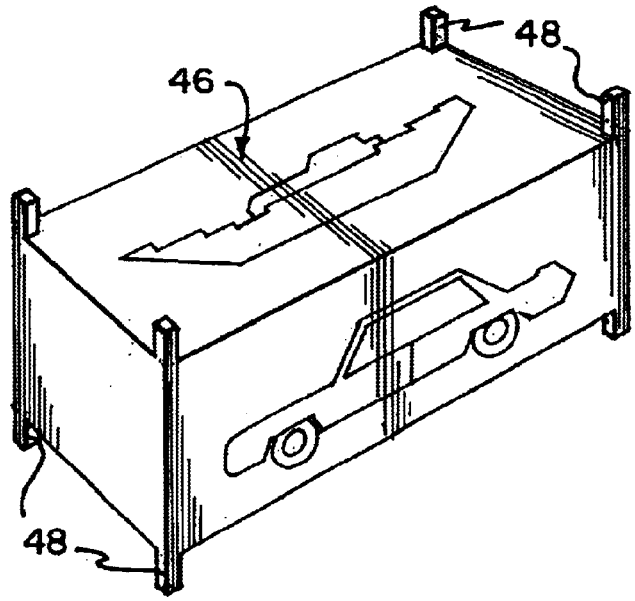
FIG. 2c
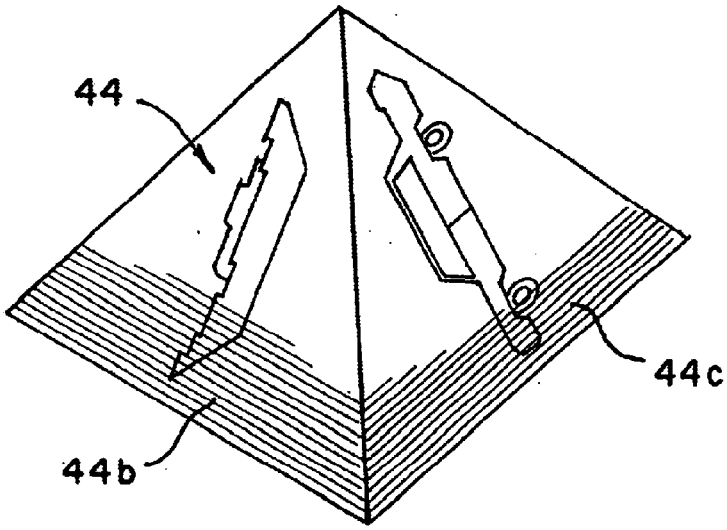
FIG. 2b

FIG. 2d
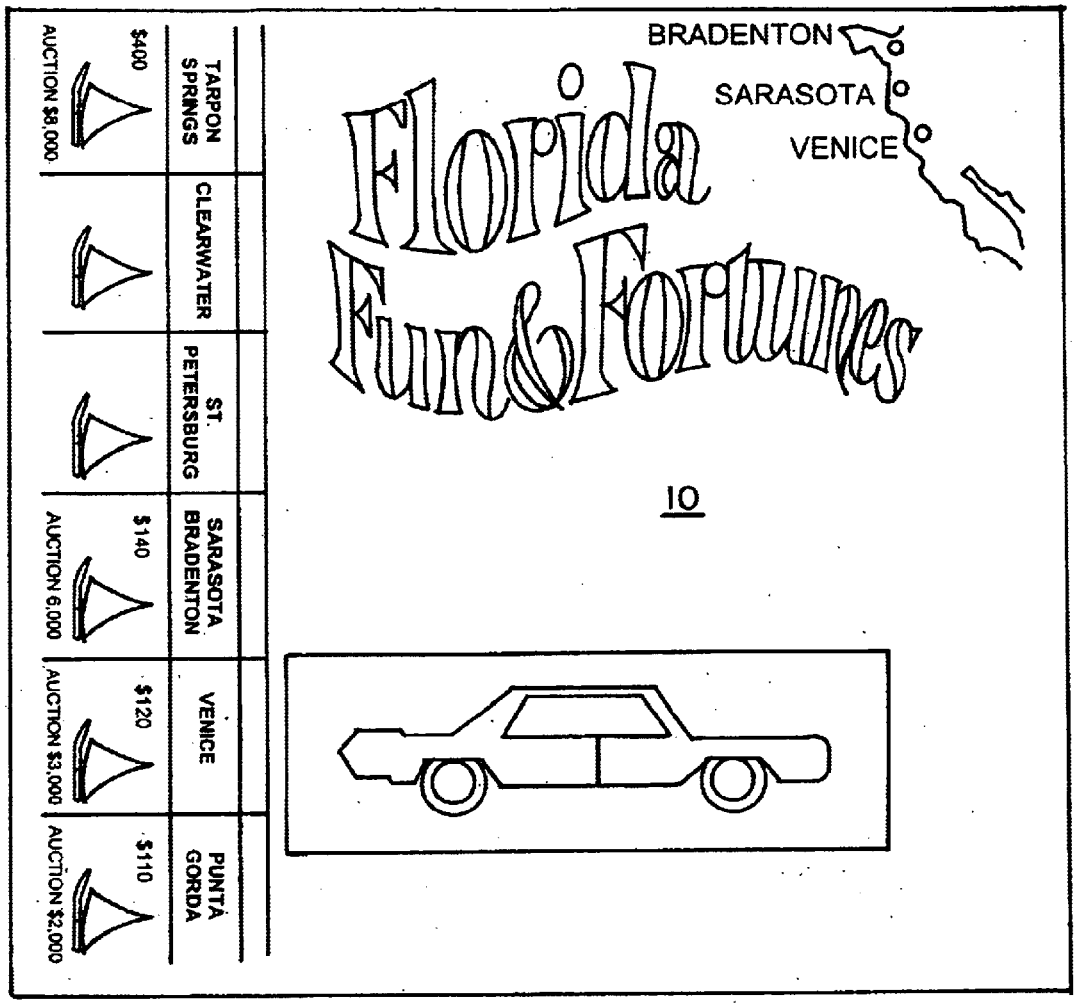
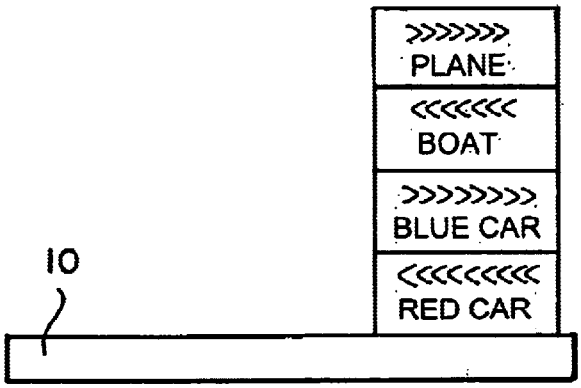
FIG. 2f

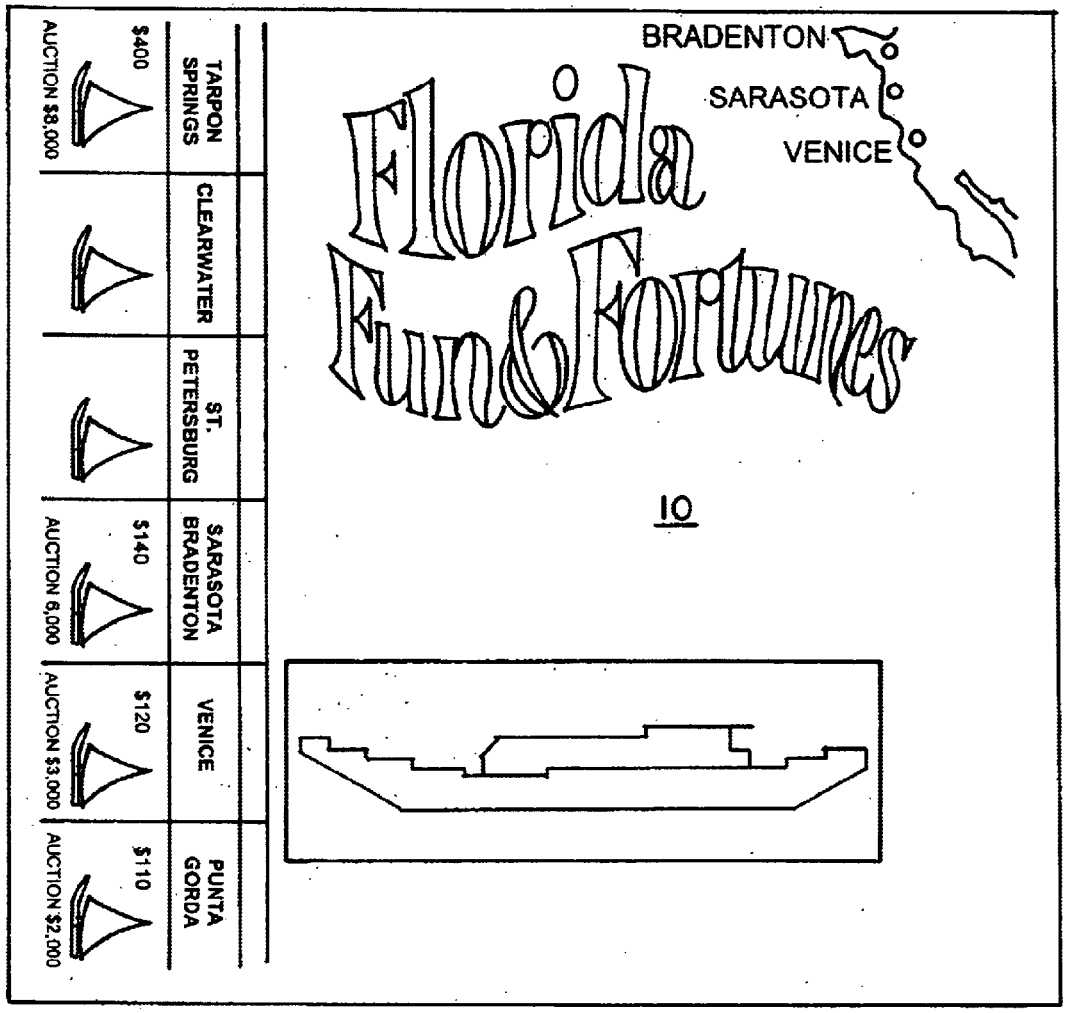
FIG. 2g
FIG. 2e
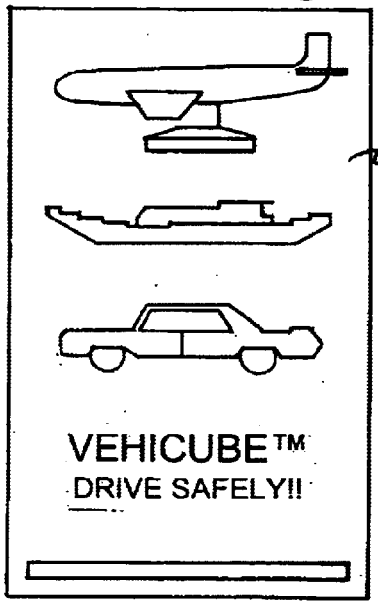
FIG. 2h
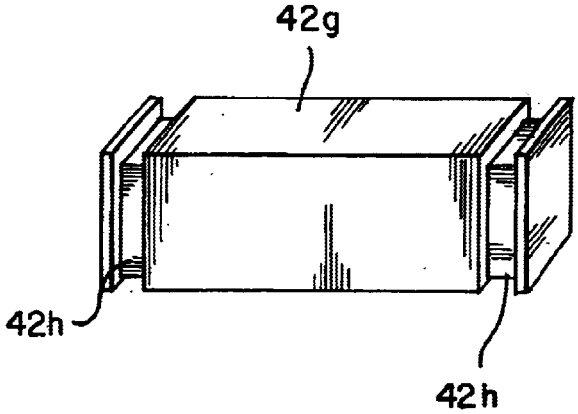

TOURIST GAME

FIELD OF THE INVENTION

The present invention relates to an improved game associated with tourist and geographical locations.

BACKGROUND OF THE INVENTION

U.S. Pat. No. 4,093,235 granted Jun. 6, 1978 describes a board game apparatus intended to educate players with respect to tourist attractions found in various geographical localities. The board game apparatus of the patent is intended to provide for the enjoyment of the players and to educate the players with respect to the particular geographical localities with which the game deals. The embodiment of the patent deals with geographical localities in the State of Florida, but the invention is intended to be applicable to many other localities, e.g., Ireland, the Caribbean, South America, Canada, other states of the United States, etc.

The game of the patent includes a game board having a series of marked areas constituting a path extending about the board, each of the marked areas representing a particular geographical locality of a region illustrated by a map outline in the central area of the board. Each of the areas is appropriately marked to indicate whether the particular locality represented by it is accessible by boat and/or by airplane conveyances. All of the localities are accessible by automobile. It is as to various tourist attractions found within the particular geographical localities represented by the marked areas with which the game is concerned. Each player is provided with a set of tokens, each set preferably comprising an automobile, a boat and an airplane. In playing the game, each player moves each one of his set of automobile, boat and airplane tokens around the board in succession, i.e., a player first moves around the board by automobile, then by boat and, finally, by airplane. In doing so, the automobile token may occupy any of the designated areas while the boat and airplane tokens may occupy only those areas designated as being accessible by boat and airplane, respectively.

One feature of the game is that players may purchase certain of the designated localities and charge rental to opposing players who land there. After purchase, a player may improve his property by constructing buildings thereon to raise the rental fees to be exacted from opposing players. Another feature of the game is to obtain rewards by successfully answering questions relating to tourist attractions within the particular localities on the game board.

In the game of the patent each player is provided with a full set of tokens each representing a type of conveyance, that is, one representing an auto, another an airplane and a third a boat. These tokens are shown as being of the same shape as the conveyance that is being represented and are made, for example, of die cast plastic or metal. The tokens are relatively small and present problems in that they can be broken or lost. Also, they are somewhat costly in that molds must be made for each. In addition players whose dexterity is impaired, for example, people suffering from arthritis and similar disease, have a problem in manipulating the tokens.

BRIEF DESCRIPTION OF THE INVENTION

The present invention is directed to an improvement of a game of the type discussed above in which the set of individual tokens is replaced by a single three-dimensional token. In the improved game according to the invention the single token is in the form of an object that has a plurality of surfaces that are preferably flat. The object can be for example, a cube, parallelepiped, pyramid, etc. On each of a plurality of the surfaces there is a representation of a type of conveyance. For example, on one surface there can be a representation of an auto, on another surface a boat and so forth. The representations can be painted, screen printed or otherwise printed on the surfaces. Since the object takes the place of a plurality of tokens, it is hereafter called a multi-token.

The multi-token is made of a durable material such as plastic, wood or metal. It can be easily molded or formed from a larger piece of material such as by cutting a piece of plastic or wood. A player uses the multi-token in playing the game in the same manner as using the individual tokens of the game of the patent by placing it on the surface of the gameboard with the side having the conveyance in play exposed and facing upwardly. When the player is to play using another type of conveyance, it is only necessary to turn the multi-token and place a surface on the gameboard so that the appropriate type of conveyance is displayed facing up.

The game with the multi-token of the invention has several advantages. The multi-token can be made in a simple and economical manner. It is durable and can be made large to permit use by a player having a dexterity deficiency.

OBJECTS OF THE INVENTION

It is an object of the invention to provide a board game representative of various geographical locations that are to be accessed during travel by various types of conveyances such as an auto, boat and airplane.

Another object of the invention is to provide a board game using a single multi-token for each player that has representations of different types of conveyances such as an auto, boat and airplane.

Yet a further object is to provide a board game representative of various geographical locations that are to be accessed during travel with each player using a single multi-token that has representations of different types of conveyances such as an auto, boat and airplane to access different locations.

BRIEF DESCRIPTION OF THE DRAWINGS

Other objects and advantages of the present invention will become more apparent upon reference to the following specification and accompanying drawings in which:

FIGS. 2*a*–2*c* are perspective views of different embodiments of multi-tokens utilized by the players each including a representation of an automobile, a boat and an airplane;

FIGS. 2*d* and 2*e* each show a portion of the gameboard with a multi-token in a different play position;

FIG. 2*f* shows multi-tokens stacked;

FIG. 2*g* is a plan view of a wrapper to be applied to the multi-token;

FIG. 2*h* is a perspective view of the multi-token to which the wrapper of FIG. 2*g* is to be applied;

DETAILED DESCRIPTION OF THE INVENTION

Figure 1:
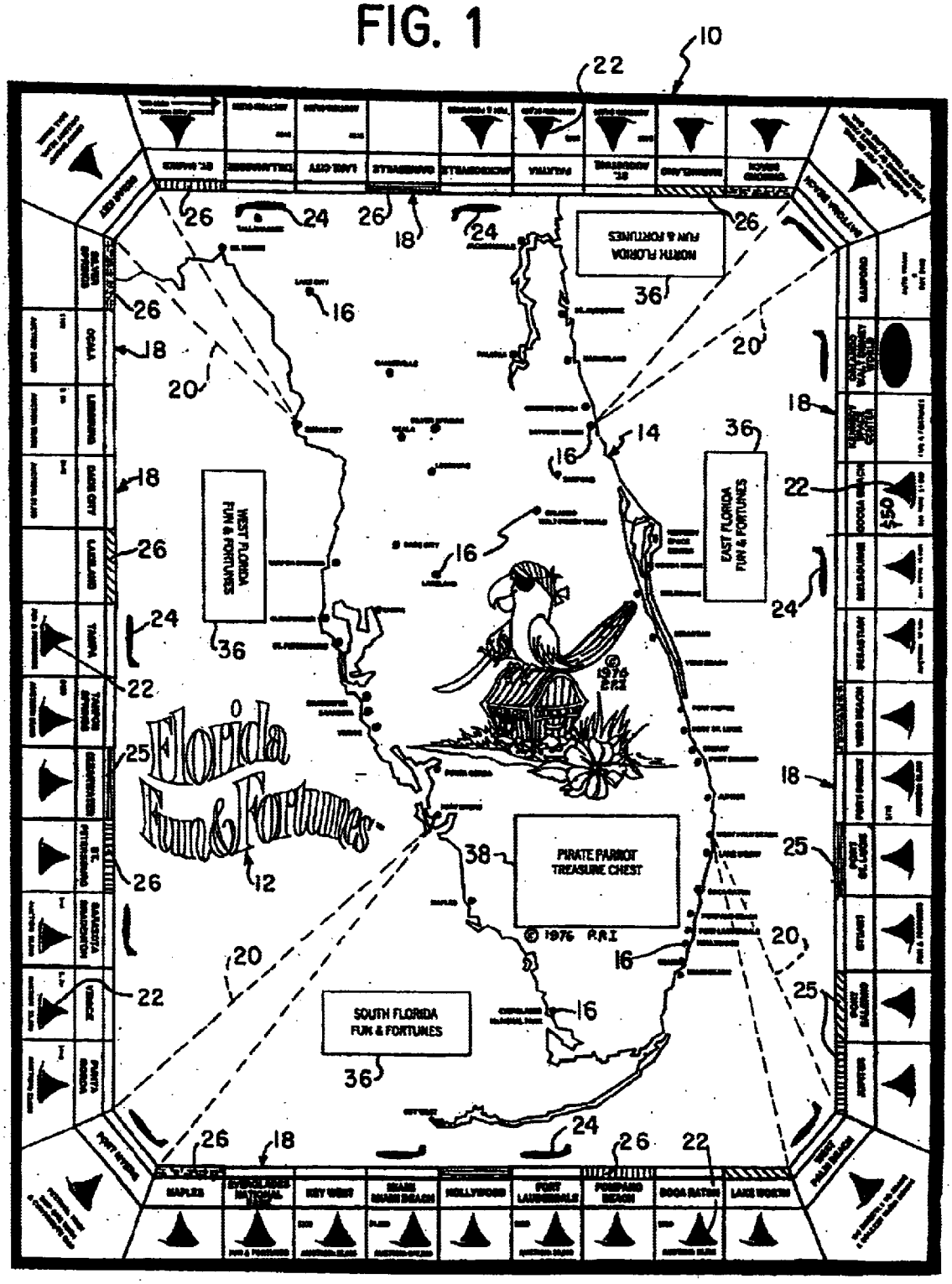
FIG. 1 is a plan view of one form of the board for the game, the name Florida Fun & Fortunes being shown inasmuch as this name is being used in marketing the present embodiment.

Before describing the play of the game in detail, a description of the playing materials comprising the game is advantageous. Referring first to FIG. 1, the board as a whole is generally denoted 10 and as the particular embodiment of the game disclosed in the drawings is known on the market as "Florida Fun & Fortunes", that name is indicated at 12 on the board. It should be understood that although the presently disclosed embodiment deals with the particular geographical region of Florida, other geographical localities are contemplated for which games coming within the scope of the present invention may be readily formulated.

An outline of a map of Florida 14 (not necessarily to scale) is provided on the central area of the board 10. Some of the larger cities and other points of interest (46 in number in the disclosed embodiment) are indicated on the map 14 by appropriate markings 16, such for example as Hollywood, Daytona Beach, Everglades National Park, etc. A series of marked areas 18 extend about the perimeter of the board constituting a path therearound. Each marked area represents one of the cities or points of interest 16 indicated on the map. Since board 10 is four-sided, the marked areas 18 on the right side of the board (as seen in FIG. 1) conveniently represent those cities and points of interest found in the eastern region of Florida. Similarly, those marked areas 18 on the lower, the left and the upper sides of the board conveniently designate the cities and points of interest located in the southern, western and northern areas of Florida, respectively. For example, the areas on the right side of the board designate Sanford, Orlando (Walt Disney World), Kennedy Space Center, etc. extending down to Jupiter. Dotted lines, denoted 20, emanate from those cities or points of interest designated by areas in the corners of the game board so that the players may readily ascertain the particular regions designated by the particular sides of the game board.

Besides being marked with the name of the particular city or point of interest (hereinafter, collectively called city) which it represents, each area has associated with it a boat or airplane designation 22, 24, respectively, indicative of whether the particular city is accessible to a tourist by boat, i.e., whether it is on a coast of Florida, and/or an airplane, i.e., whether the city has an airport so as to be accessible by air. Thus, for example, Cocoa Beach (east coast) has a boat designation 22 indicating that it is accessible by boat, Tallahassee (northern region) has an airplane designation 24 associated with it indicative of the fact that an airport is situated there, and Tampa (west coast) has both a boat 22 and airplane 24 designation associated with it indicative of the fact that it is accessible both by airplane and by boat. Some cities, e.g., Ocala, Leesburg and Dade City have neither boat nor airplane designations associated therewith indicating that they are accessible by neither. It is understood, however, that all of the cities represented on the board are accessible to a tourist by automobile.

Sixteen of the marked areas 18 have a portion 26 marked in color, in the present embodiment four being marked in blue, four in red, four in green and As four in yellow. One of each of these color-coded areas 25 is found on each of the four sides of the board. For example, Lakeland, Marineland, Port Salerno, and Lake Worth are each marked in green. Those areas not being color-coded are marked either with a designation comprising an instruction to select a question card, described in detail hereinbelow, or may have an auction price associated with it for purposes also described in detail hereinbelow. For example, areas 18 designating Tampa, Everglades National Park, Stuart, Kennedy Space Center, and Jacksonville are provided with the designation, "Fun & Fortunes" which, as described below, denotes an instruction for a player who lands on that area to select a question card. On the other hand, areas 18 designating such localities as Sarasota, Bradenton, Miami Beach, Fort Pierce and Tallahassee have auction prices associated with them. Further, each of the areas having associated auction prices have expense fees also associated with them. For example, area 18 designating Key West, in addition to having an auction price also has an expense fee of $300.00 associated with it.

Four spaces 36 are located in the central board area, each being provided in one of the geographical regions defined by dotted lines 20. These spaces indicate the places where the sets of question and instruction cards, hereinafter referred to as "Fun & Fortunes" cards 46, are placed. Finally, a space 38 is provided on the game board, here being located within the outline of map 14 indicating the place where a set of reward cards, hereinafter referred to as "Pirate Parrot Treasure Chest" cards 64 are to be placed.

Areas 18 which occupy the four corners of the game board contain certain instructions which must be followed by the player who lands on such areas. For example, the area representing Daytona Beach, upon being landed upon, requires the player to pay a cash penalty and results in the loss of a Pirate Parrot card (reward card) under certain circumstances, explained below. Similarly, should a player land on the area 18 designating West Palm Beach, he is instructed to move his token to Miami and collect a cash bonus. This completes the description of the game board 10. However, as mentioned hereinabove, it should be understood that other geographical regions may be used as a basis for the gameboard within the scope of the present invention with the areas 18 indicating other appropriate cities and/or points of interest within such regions. In such other embodiments of the game, the areas 18 will be marked with designations 22, 24 in a manner similar to that shown in the present embodiment, i.e., with designations indicating whether such areas are accessible by boat and/or airplane.

FIG. 2*a* shows one embodiment of the multi-token 42. Here it is an elongated three-dimensional parallelopiped, having six flat sides. The dimensions illustratively can be 2×¾×¾ inches with the length being the two inch dimension. The multi-token 42 can be of a solid color, a different one to be provided for each player. Alternatively, all of the multi-tokens can be of the same color and the representations of the conveyances in different colors to correspond to the player. For example, all of the multi-tokens can be white and all of the representations of conveyances on one can be in red, another all in blue, and so on, to correspond to the identity of each player. On the side surfaces are the representations of the conveyances. The surfaces 42*a* and 42*b* respectively show the automobile and the plane. The hidden surface opposite 42*c* or 42*d* would have the boat. One surface of the multi-token 42 is uppermost, shown as 42*a*, to indicate the conveyance which is in play. If desired, the opposite ends 42*e* of the multi-token can be of different colors, such as green and red, with the words GO and NO GO to determine precise positioning on the gameboard.

FIG. 2*g* shows another form of multi-token 42*g* that has gripping wings 42*h* on the ends. Here, a sheet of paper 42*i* or foil has the conveyances printed thereof. The sheet 42*i* is wrapped around the token 42*g* so that a conveyance is on each surface.

In use, the multi-token is oriented to display the conveyance in play on the top surface and pointing in the correct direction. FIG. 2*d* shows a multi-token 42 with a car at halt in a GO position. The green end of the multi-token would point toward the board center. FIG. 2*e* shows a boat at halt in NO GO position and the red end of the multi-token would point toward the board center. Multi-tokens can be stacked one on top of the other when several players arrive at the same location. This is shown in FIG. 2*f*.

FIG. 2*b* shows an alternate form of multi-token 44 of pyramid shape. On the faces 44*b* and 44*c* are the respective representations of a boat and an airplane. Here the apex of the pyramid can correspond to GO and precisely point to the locationon the board and the base to NO GO. As with the multi-token 42, the token itself can be of a solid color or the representations of a color to correspond to the player. The multi-token 44 is oriented to display the conveyance in play.

FIG. 2*c* shows a multi-token 46 which is a modification of that of FIG. 2*a*. Here, posts 48 are provided on the corners of each surface and the posts rest on the gameboard. The space from the gameboard provided by the posts permits the conveyance to be placed in a somewhat more fanciful manner as by raised surface embossing. Here also, either the multi-token itself or the representation of the conveyance can be of a color to identify the player.

Figure 3A:
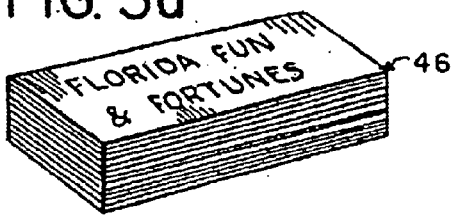
FIGS. 3(*a* and *b*) represent question and instruction cards (FIG. 3*a*) is containing questions concerning tourist attractions of the geographical localities provided on the board while FIG. 3(*b*) represents corresponding answers to the questions on these cards.

FIG. 3*a* illustrates the Florida Fun & Fortunes cards 46. Each card either contains instructions to "visit" a particular tourist attraction found in one of the cities contained on the game board, or may contain a question which may be answered by a "true" or "false". Finally, a card 46 may simply set forth a reward or penalty for the player choosing that card. In one embodiment of the invention there are two hundred such Florida Fun & Fortunes cards. Of these 200, 100 are of the "visit" or "true-false" type and these cards are numbered from 1 to 100. The remainder are penalty or reward cards. In a preferred embodiment, each of the cards has both the "true" and "false" question and the "visit" instructions. There can be, for example, one hundred of these cards which are numbered. The player is to first correctly answer the "true" or "false" question before moving on to the "visit" instructions.

Figure 3B:
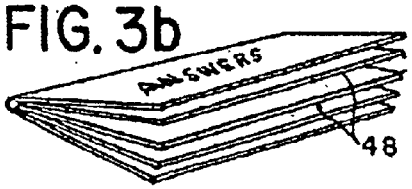

FIG. 3*b* illustrates an answer booklet 48 containing the correct answers to the questions contained on the numbered Florida Fun & Fortunes cards. For example, one of the numbered Florida Fun & Fortunes cards may say "Visit the Monkey Jungle". The booklet could be in sheet form. If the player correctly answers "Miami" (as verified by the answer in booklet 48) he may move his token to Miami. This will be explained in greater detail hereinbelow.

Figure 4:
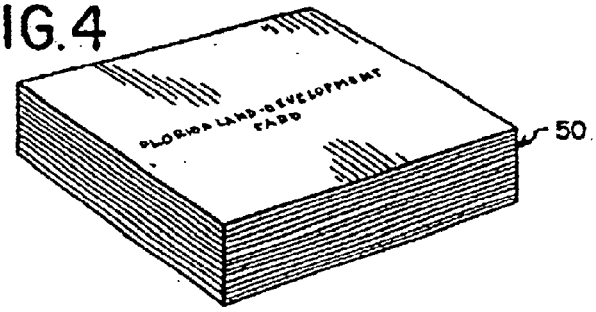
FIG. 4 represents title cards each representing ownership of a particular geographical locality shown on the board.

FIG. 4 illustrates a series of land development cards 50. Each land development card corresponds to a particular city represented by one of the areas on the game board. Each card gives information pertaining to the cost of making improvements in that particular area as well as the cost to an opposing player if he should land on the area designating that particular city during play of the game. Each land development card 50 actually represents the title or deed to property within a particular city.

Figure 5A:
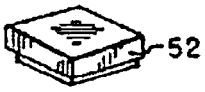
FIGS. 5*a* through *d* illustrate a motel, a condominium, a marina club and a riding club, respectively, each of which constitutes an improvement which may be made in the localities after being purchased by a player.
Figure 5B:
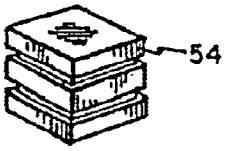
Figure 5C:
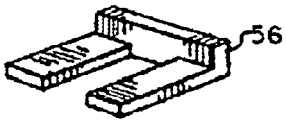
Figure 6:
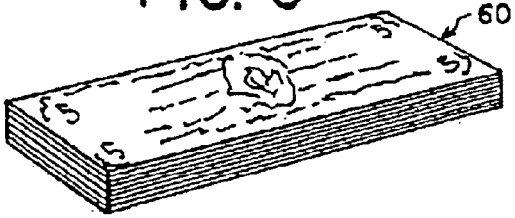
FIG. 6 illustrates scrip money (or travelers checks) used in playing the game.
Figure 5D:
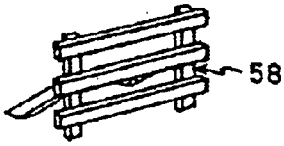
Figure 7:
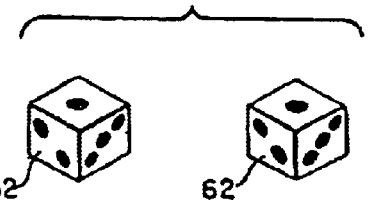
FIG. 7 illustrates the dice used to determine the extent of the moves of the players along the path on the board.
Figure 8:
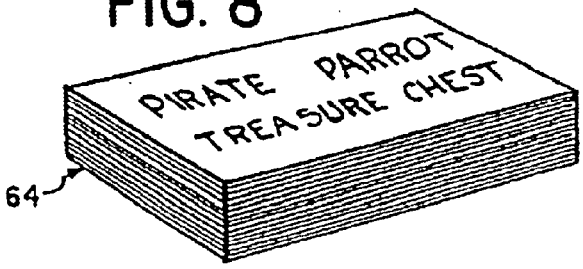
FIG. 8 represents a set of reward cards each of which, in the present embodiment, includes the picture of an animal found in or related to the ecology of the particular geographical region and an indication of a sum of money to be awarded to a player upon obtaining the card.

FIGS. 5*a* through *d* illustrate various symbols for improvements which may be made by a player to a city which he acquires. FIG. 5*a* illustrates a motel 52, FIG. 5*b* illustrates a condominium 54, FIG. 5*c* illustrates a marina club 56 and FIG. 5*d* is a symbol for a riding club 58. FIG. 6 illustrates scrip money or, as referred to in the present invention, travelers checks 60 which are provided in different denominations. FIG. 7 illustrates dice 62 used to determine the number of spaces to be moved during play of the game. Finally, FIG. 8 illustrates a set of Pirate Parrot Treasure Chest cards 64, each card having a picture of a character, e.g., animal, fish, etc. thereon and an indication of a cash reward to a player who obtains the card during play of the game.

A description of the manner in which the game is played will now be set forth. It should be understood, however, that this is merely one of several games which may be played using the apparatus described hereinabove. Each player is assigned a multi-token 42, 44 or 45 of a color or the pictures thereon, of, for example, blue, red, green or yellow. Depending upon the assigned color, the player begins the game already owning those properties on the game board marked in the same color as his multi-token. Each player is also issued a stated amount of scrip money 60 prior to beginning the game.

Each player places his multi-token with the automobile facing up on the area marked Orlando which functions as the starting position. The players then each roll one die in predetermined order, each player moving his multi-token the particular number of units shown. When using the multi-token wit the automobile displayed, each and every area 18 must be counted in moving the multi-token. If the player lands on a Fun & Fortunes position, such as the Kennedy Space Center, he draws a Fun & Fortunes card 46 from the deck for that region(east). If he draws a numbered "visit" card, he must correctly name the particular city in which the tourist attraction which the card requests him to visit is located. If the card sets forth a true-false question, the player must correctly answer that question. If the answer is not correct or the player does not correctly name the city in which the stated tourist attraction is located, he must pay each player a stated amount of money, for example, $5,000. He must also skip one turn. However, if the question is answered correctly, the player advances his card to the city indicated (in the case of correctly answering a "visit" card) and, upon arriving at that city, he draws a Pirate Parrot Card 64 and collects the reward stated thereon. The player retains the Pirate Parrot Card for further play.

In this way, it may be seen that the players become educated as to the locations of various tourist attractions within the State of Florida. Additionally, all the players become familiar with the geography of the area by virtue of the map and the arrangement of the playing board. If the player correctly answers a true-false question, he draws a Pirate Parrot Card and collects his reward from the bank. In this case, the player remains in place. If a player draws an unnumbered card from the Fun & Fortunes deck, he simply follows the instructions on the card. Unless otherwise indicated, he pays to or collects from the bank whatever amount is mentioned on such an unnumbered card.

If a player lands on a property area 18 indicated to be available at auction, for example, Cocoa Beach, Melbourne, Sebastian, etc., he must pay the bank the "expense fee" shown on the gameboard (for example, $50.00 at Cocoa Beach) and then may open a bidding procedure to purchase the property at the price shown on the game board (for example, $3,000 for Cocoa Beach). Each player gets a chance to raise the initial bid. When all players have offered a bid, this is counted as one round of bidding. Any number, for example, three, of rounds may be conducted. The highest bidder at the end of three rounds then takes ownership of that property by paying the amount bid to the bank and retains the appropriate land development card 50. Any player, other than the owner, who lands on this property must now pay the owner an expense fee as well as rent, which latter amount is shown on the land development card. If a player lands on a color-coded property area 18 not owned by him, he must pay the rent (camping fee) shown on the appropriate land development card to the owner of that property. Whenever a player lands on an opponent's property, that player loses one turn. If the player happens to own the property himself, he pays no rental and does not skip a turn. Instead, he may immediately roll again.

When a player has landed on an area which is his own property, he may improve it by installing a motel 52, condominium 54, etc., at a cost shown on the corresponding property card. However, he loses a turn when doing so. Under the preferred rules, no player can make improvements in property until he has first obtained at least one Pirate Parrot Treasure Chest Card 64 (by correctly answering a question set forth on a Fun & Fortunes card 46). Thus, correctly answering a Florida Fun & Fortunes card is a prerequisite to improvements on property. Accordingly, a thorough knowledge of the geographical region with which the game is concerned is rewarded by not only the cash reward obtained when correctly answering a Florida Fun & Fortunes question, but also by then being able to improve the properties which he owns.

While traveling by car, if a player lands on an area owned by an opponent, he must pay the owner the highest rental based upon the most expensive building installed on that property. If no buildings are installed, then he must pay the land rental (camping fee) for that position. If the owner owns two adjacent pieces of property without buildings, the player must pay the combined land rental for both. If buildings are installed, the player must pay the highest single building rental even if the building is positioned on adjacent property. Certain rules may be used in the event a particular player lands upon an area already occupied by one or more players. For example, if the area is designated a Fun & Fortunes position, each of the earlier players currently located in that area may lose an additional roll of the die. If the area is a property belonging to another player, all players in that area must pay twice the rental due.

After one circuit around the board by automobile, if a player has not obtained a Pirate Parrot Treasure Chest card, he must continue around the board still using his automobile token and, therefore, must still count each and every area in his movement. However, once a player has obtained at least one Pirate Parrot Treasure Chest card, and he has made one circuit around the board (having passed Orlando), he may now switch the orientation of his multi-token to display his boat. When traveling by boat, players again use only one of the two dice. Also, importantly, only the areas having a boat designation 22 associated therewith are counted in the movement of the multi-token and positions not having such designation may be skipped. A preferred rule is that players may not pass the area 18 designating St. Marks by boat. This naturally is due to the fact that there is no waterway connecting St. Marks and Jacksonville as may be seen from the map in its northernmost portion. Thus, when a player reaches St. Marks, he must stop there, change the orientation of his multi-token to display to his car and roll the die again at his next turn. He then advances by car (counting every area) until he has landed on a boat position at or past Jacksonville whereupon the multi-token is oriented to display the boat to be used again. Should a player traveling by boat be instructed by a Fun & Fortunes card to move to an area that does not contain a boat pictured on the game board, he advances to the furthest area having a boat designation before that area whereupon he changes orientation of his multi-token, at his next turn, to his car. He then advances directly to the intended locality.

Should a player who is traveling by boat desire to stop in a land locked area (e.g., Lakeland, Dade City, Leesburg, etc.) in order to purchase such area, he must stop upon reaching a prior area having a boat designation 22 whereupon he may rent a car for a stated sum, e.g., $100.00, and roll the die again at his next turn. Again, if a player has not obtained a Pirate Parrot Card 64 during his tour by boat around the game board, he must travel around again by boat until he does obtain one.

Upon obtaining a Pirate Parrot Card while traveling by boat and thereupon passing Orlando, he must now switch orientation of his multi-token to display the airplane to continue his travels. In traveling by plane, the player actually has the most versatility in the movement of his multi-token so as to enable him to get to areas 18 having Fun& Fortunes designations in order to provide chances for acquiring further Pirate Parrot Cards. When traveling by plane, a player rolls both dice and may choose one of the two numbers shown on his roll of the dice as his move for the airplane token. He advances his multi-token oriented to display the plane in the usual manner that number of spaces, counting only the areas marked with the airplane designation 24. The other number shown on the second die may be the player's move by boat from his landing spot by plane. If no boat appears on the landing spot on the game board (such as Tallahassee and Orlando), the player must travel by car from that landing spot until he lands at a boat position. Once there, he must skip one turn while switching to his boat.

With respect to improving the properties, only one building of each type may be installed on a single property. Each land development card indicates the types of buildings which may be installed on each property. Although an owner can install a building at any time in the game when it is his turn to move, he must start with the least expensive building, i.e., the motel 52 and may then install the marina club 56 (or riding club 58 where applicable) and then the condominium 54. Of course, buildings may be installed only on areas 18 having land developments cards, i.e., the color-coded areas and those available at auction. The value of a particular property is determined by the sum of the individual buildings and the particular land value of that area. Property (with buildings) may be sold to the bank or to any other player at or above the value shown on the land development card. If more than one player is interested in buying such property, the property may be auctioned.

The game ends when one or more of the following situations occur: a predetermined time limit has been reached; all of the Pirate Parrot Treasure Chest Cards have been drawn, or when all competing players concede. At the point in time when the game ends, the player with the largest holdings in cash plus land and buildings is the winner.

As stated hereinabove, the rules described above are illustrative only and other rules may be adopted. It is clear from the description of the game that the players are educated as to the particular points of interest, attractions and geography of the area with which the game is concerned. The unique cooperation of the areas designating the cities and/or points of interest as being accessible by car, boat and/or airplane with their representations on the multi-token adds another educational feature to the game, indicating which cities and points of interest are accessible by car, boat and/or airplane. The Pirate Parrot Treasure Chest Cards, as indicated above, may contain pictures of animals indigenous to the area with which the game is concerned to further add another educational element to the game.

Obviously, numerous modifications and variations of the game are possible in the light of the above teachings. Accordingly, the game may be practiced other than as specifically described hereinabove.

I claim:

1. A board game apparatus designed to acquaint players with a predetermined geographical region as represented on a map, said apparatus comprising:

a board having predefined directions thereon corresponding to directions on said map and including a series of marked areas forming a path extending about said board, each of said marked areas representing a particular locality within said region, having indicia therein identifying said locality, and being disposed on said board to correspond generally with the location of said locality on said map, selected ones of said marked areas on said board being designated as accessible only by indicated modes of transportation;

a plurality of multi-tokens, each said multi-token dedicated to a different player and being moveable for transportation along said path, wherein each said multi-token (a) is an elongated parallelepiped comprising a body with four flat sides and two opposite ends, (b) the surface of each of at least three of said flat sides has a respective visual representation of a different mode of transportation for use by the corresponding player, and the said flat sides permitting vertical stacking of a plurality of said tokens with each token in a stack displaying at least two flat sides and one visual representation of a mode of transportation, (c) each of the opposite ends of said elongated parallelepiped body having a gripping wing that is within the outer periphery of said body of said object and that is spaced from said body to form a recess and that has on the outer surface of the respective gripping wing a respective visual indication of movement of the multi-token relative to said board, with one of said visual indications of a gripping wing to be placed facing a said marked area and the other facing the opposite direction to be viewed to indicate the playing status of the multi-token, each multi-token to be moveable only with respect to marked areas corresponding to localities accessible by the corresponding mode of transportation; and means for determining the movement of each said multi-token means about said path.

2. A board game as in claim 1 wherein each of the representations of a mode of transportation on a token is of the same color to identify the player associated with it and the multi-tokens of the game each have different colors of the representations to identify a respective player.

3. A board game as in claim 1 wherein each of the multi-tokens of the game is of a different color to identify a player.

4. A board game apparatus as recited in claim 1 wherein said region is an existing geographical region, said localities being geographical localities existing within said region, said accessibility designations being indicative of the actual accessibility of said localities by land, water and air modes of transportation, said representations of each multi-token corresponding, respectively, to means for traveling by land, water and air modes of transportation.

5. A board game apparatus as recited in claim 4 wherein selected ones of said areas are designated by colors so as to constitute a distinguishable group.

6. A board game apparatus as recited in claim 5 wherein each such area comprising one of said groups is on a different side of said board.

7. A board game apparatus as recited in claim 4 wherein selected areas have indicia indicating charges required for the use and occupancy of said areas by opponent players.

8. A board game apparatus as recited in claim 7 further comprising means for increasing the rentals for a particular area by the acquisition of localities represented by areas adjacent to said particular area.

9. A board game apparatus as recited in claim 4 further including a set of cards, each card having indicia thereon representing either a question whose answer is one of said geographical localities on said board or other instructions, selected areas on said board having instructions thereon to select one of said set of cards upon a player landing thereon.

10. A board game apparatus as recited in claim 9 further including a set of reward cards, a player obtaining one of said reward cards upon correctly answering a question contained on a question card.

11. A board game apparatus as recited in claim 4 further including a set of cards, each card representing the ownership of a particular one of said geographical localities, each said card containing indicia thereon indicative of the value of said locality at various stages of improvement.

12. A board game apparatus as recited in claim 11 further including a set of pieces for the purpose of purchase and placement on said areas representative of improvements in said geographical localities represented by said areas.

13. A board game apparatus as recited in claim 4 wherein selected ones of said areas have indications of opening bids required for a player to purchase the locality represented by said area.

14. A board game apparatus as recited in claim 4 wherein each of said mode of transportation representations on a multi-token is constructed and arranged to be distinguishable from every other representation of the multi-token and has a priority designation, a higher priority representation of a multi-token being moveable only after every lower priority representation of the multi-token has made a complete circuit of said path.

15. A board game apparatus as recited in claim 1 wherein each such area comprising one of said groups is on a different side of said board.

16. A board game apparatus as recited in claim 1 which is adapted to acquaint each player with sites in said region and further comprises a set of cards including cards having a question with respect to said region which must be answered by a player and cards including instructions, selected areas on said board having instructions thereon to select one of said set of cards upon a player landing on one of said selected areas.

17. A board game apparatus as recited in claim 16 further comprising a set of reward cards, a player obtaining one ofsaid reward cards upon correctly answering a question contained on a question card.

18. A board game apparatus as recited in claim 1 further comprising a set of property cards, each property card representing the ownership of a particular one of said localities, each said card containing indicia thereon indicative of the value of said locality at various stages of improvement.

19. A board game apparatus as recited in claim 18 further comprising a set of indicators for purchase, said indicators representing improvements in said localities represented by said areas.

20. A board game as in claim 1 where the visual indications of movement of a multi-token on the outer surface of the gripping wings comprise GO and NO GO indications.

21. A board game as in claim 20 wherein the color the GO indication is green and the color the NO GO indication is red.

22. A board game apparatus as in claim 1, wherein a plurality of multi-tokens stacked at a marked area has each multi-token in the stack displaying its respective visual indication on the respective gripping wings displayed.

23. A board game apparatus as in claim 1, wherein each said multi-token is of a different color to identify the player to which it belongs.

24. A board game apparatus as in claim 1 wherein said visual indication on the outer surface of a gripping wing at each end of a said multi-token body is of a different color.

25. A board game apparatus as in claim 24 wherein there also is a printed indicia of GO and NO GO on each of visual indications.

* * * * *